US005135021A

United States Patent [19]

Pegg

[11] Patent Number: 5,135,021

[45] Date of Patent: Aug. 4, 1992

[54] PLUMBING APPLIANCE

[76] Inventor: John L. Pegg, 2637 Capitol Ave., Des Moines, Iowa 50317

[21] Appl. No.: 749,994

[22] Filed: Aug. 26, 1991

[51] Int. Cl.[5] ..... F16K 49/00

[52] U.S. Cl. ..... 137/337; 126/362

[58] Field of Search ..... 137/337; 126/362

[56] References Cited

U.S. PATENT DOCUMENTS

| | | | |
|---|---|---|---|
| 2,842,155 | 7/1958 | Peters | 137/337 |
| 3,783,897 | 1/1974 | Pegg et al. | 137/337 |
| 3,929,153 | 12/1975 | Hasty | 137/337 |
| 4,697,614 | 10/1987 | Powers et al. | 137/337 |

*Primary Examiner*—A. Michael Chambers
*Attorney, Agent, or Firm*—Lundy & Associates

[57] ABSTRACT

A valve body with a hollow interior chamber. Hot liquid and cold liquid conduits provide for transporting hot liquid and cold liquid from a hot liquid source and a cold liquid source to the hollow chamber. The valve body has a pair of passages joining the hollow chamber to the hot liquid and cold liquid conduits. The passage joining the hot liquid conduit to the chamber has a flow valve therein and the passage joining the hollow chamber to the cold liquid conduit has a check valve therein. The valve body is mounted at a level higher than the hot liquid source.

17 Claims, 4 Drawing Sheets

PLUMBING APPLIANCE

BACKGROUND OF THE INVENTION

The present invention pertains to plumbing appliances and more particularly pertains to an appliance used in conjunction with sinks, bathtubs, showers, and other conventional pressurized systems having hot and cold liquid faucets.

Conventional faucets are characterized by flow valves which control the rate of flow of pressurized hot liquid and cold liquid from the faucet.

In the static state when flow valves are in the shutoff position and no liquid is flowing from the faucet, hot liquid in the hot liquid conduits leading to the faucet cools. Therefore, depending on the interim of time that has elapsed since the faucet delivered hot liquid, an alotted period of time may be necessary before hot liquid once again becomes available from the faucet. The problem is further compounded with plumbing arrangements where the hot liquid source is positioned distant relative to the faucet as is the case with hotels, restaurants, and other large structures requiring complicated plumbing systems. Many hotels provide free instant coffee or soup, but no instantly available hot water. One must wait for the cold liquid or water in the hot liquid conduits leading from the hot liquid source to the faucet to be displaced and hot liquid or water to become available at the faucet.

It is therefore highly desirable to provide an improved plumbing appliance.

It is also highly desirable to provide an improved plumbing appliance which can provide hot liquid at the hot liquid outlet at all times.

It is also highly desirable to provide an improved plumbing appliance which enables the selection of the temperature of hot liquid to be made from a position that is conveniently placed near the faucet.

It is also highly desirable to provide an improved plumbing appliance which can provide hot liquid at the hot liquid outlet at all times without wasting water.

It is also highly desirable to provide an improved plumbing appliance which enables the selection of the temperature of hot liquid to be made from a position that is conveniently placed near the faucet without wasting water.

It is finally highly desirable to provide an improved plumbing appliance which meets all of the above desire features.

SUMMARY OF THE INVENTION

It is therefore an object of the invention to provide an improved plumbing appliance.

It is also an object of the invention to provide an improved plumbing appliance which can provide hot liquid at the hot liquid outlet at all times.

It is also an object of the invention to provide an improved plumbing appliance which enables the selection of the temperature of hot liquid to be made from a position that is conveniently placed near the faucet.

It is also an object of the invention to provide an improved plumbing appliance which can provide hot liquid at the hot liquid outlet at all times without wasting water.

It is also an object of the invention to provide an improved plumbing appliance which enables the selection of the temperature of hot liquid to be made from a position that is conveniently placed near the faucet without wasting water.

It is finally an object of the invention to provide an improved plumbing appliance which meets all of the above desired features.

In the broader aspects of the invention there is provided a valve body with a hollow interior chamber. Hot liquid and cold liquid conduits provide for transporting hot liquid and cold liquid from a hot liquid source and a cold liquid source to the hollow chamber. The valve body has a pair of passages joining the hollow chamber to the hot liquid and cold liquid conduits. The passage joining the hot liquid conduit to the chamber has a flow valve therein and the passage joining the hollow chamber to the cold liquid conduit has a check valve therein. The valve body is mounted at a level higher than the hot liquid source.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
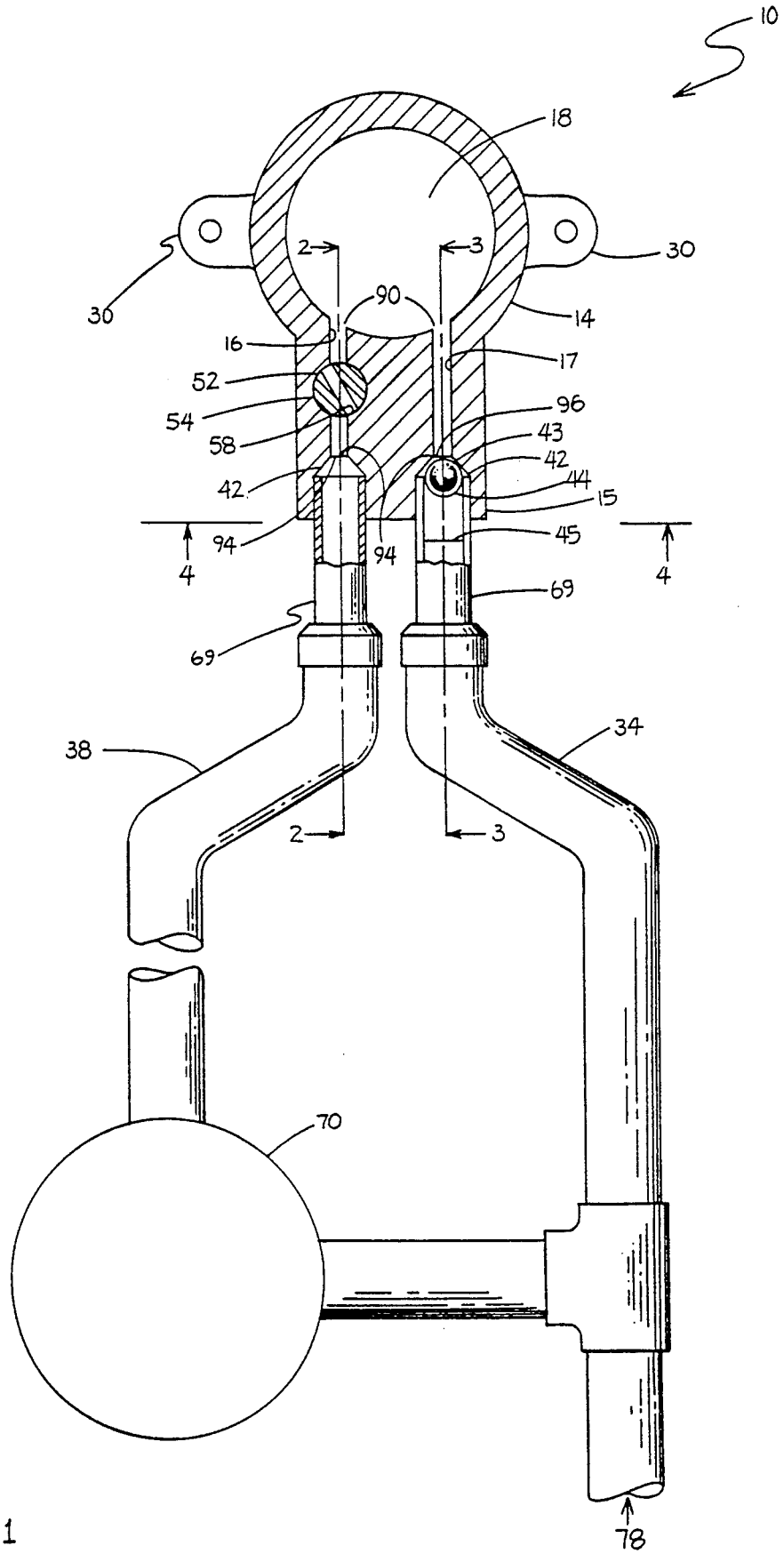
FIG. 1 is a view schematically showing the appliance with a cross-sectional view of the chamber of the invention.
Figure 7:
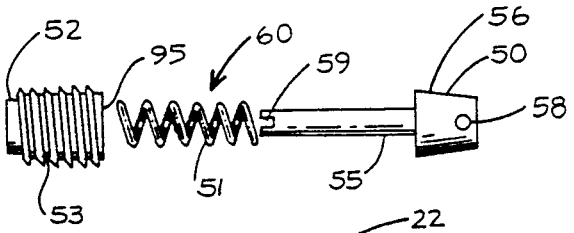
FIG. 7 is an exploded view of the valve member of the invention.

The plumbing appliance 10 of the invention has a body 14 with an extension portion 15. Body 14 has a hollow interior chamber 18 having a cylindrical side wall 22. Body 14 is preferably cast in one piece from suitable metal, such as bronze. In the embodiment illustrated in FIG. 1, a pair of mounting ears 30 are integrally cast on body 14 for suitably mounting appliance 10. Other embodiments of appliance 10 have other mounting means suitable for supporting weight of body 14 or rely on suitable fittings 69 and the conduit system generally to support body 14.

Extension portion 15 of body 14 has hot liquid passage 16 and cold liquid passage 17 therein. Cold liquid passage 17 and hot liquid passage 16 each have hollow chamber end 90 and hot and cold liquid conduit end 94 which join cold liquid conduit 34 and hot liquid conduit 38 thus allowing the flow of hot and cold liquid or water into hollow chamber 18. Both hot liquid passage 16 and cold liquid passage 17 are relatively smaller in diameter relative to hot liquid and cold liquid conduits and have inlet ports 42 secured at hot and cold liquid conduit ends 94, respectively. Inlet ports 42 are tapered at one end and complement the reduced diameter of hot liquid passage 16 and cold liquid passage 17. Inlet ports 42 may be cast integrally in extension portion 15 of body 14 as shown or may be made of conventional plumbing hardware and secured to hot and cold liquid conduit end 94 of hot liquid and cold liquid passages 16, 17 in other embodiments. Hot liquid conduit 38 and cold liquid conduit 34 serve as transporting means for hot and cold liquid from hot liquid source 70 and cold liquid source 78, respectively.

Figure 2:
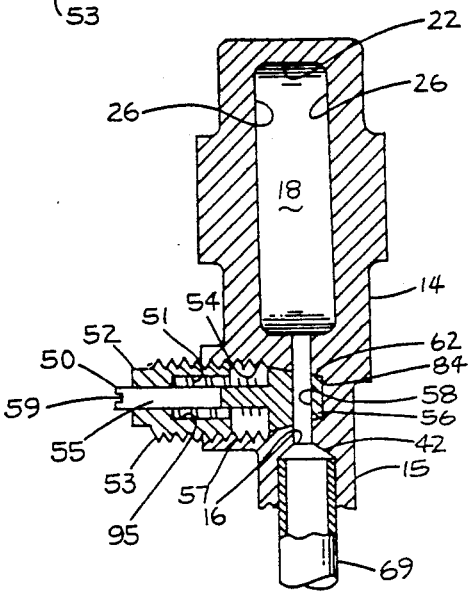
FIG. 2 is a cross-sectional view taken substantially along section line 2—2 of FIG. 1.
Figure 4:
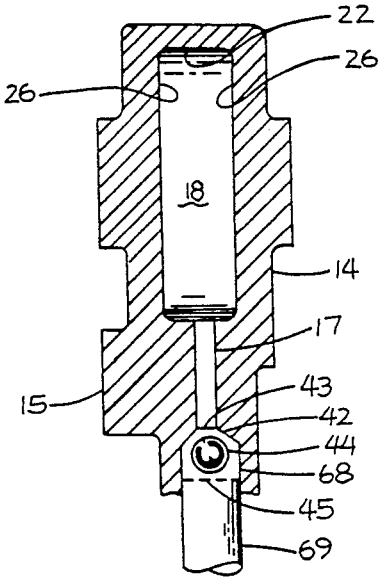
FIG. 4 is a cross-sectional view taken substantially along line 4—4 of FIG. 1.
Figure 3:
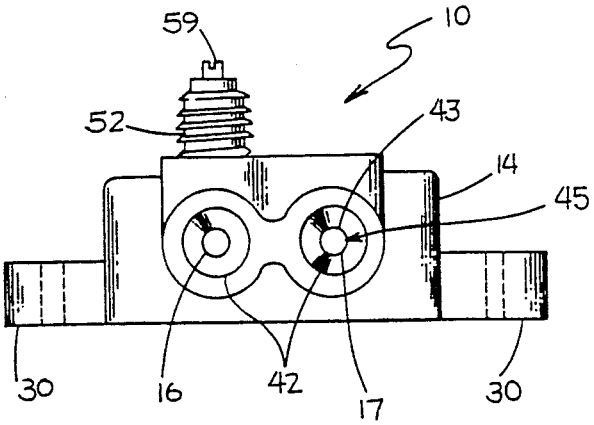
FIG. 3 is a cross-sectional view taken substantially along section line 3—3 of FIG. 1.

Referring additionally to FIGS. 2, 3 and 4, extension portion 15 of body 14 has transverse opening 54 therein. Transverse opening 54 is positioned transversely of hot liquid passage 16. Transverse opening 54 has internal threads 57 and a tapered inner portion 62 suitable for containing valve member 50 therein. In the embodiment illustrated, valve member 50 has an adjusting valve stem 55, a valve head 56 and a slot 59. A bore 58 in valve head 56 is of the same diameter as hot liquid passage 16. A compression spring 51 is positioned helically about adjusting valve stem 55. Valve member 50 is positioned in transverse opening 54 with valve head 56 entering transverse opening 54 first with slot 59 outwardly extending from transverse opening 54. Compression spring 51 is held in a tensed position helically about adjusting valve stem 55 by plug member 52. Plug member 52 has interior 95 suitable for preventing compression spring 51 from passing therethrough and external threads 53. In the embodiment illustrated, as shown in FIG. 2, plug member 52 can be threadedly engaged in transverse opening 54. Compression spring 51 urges valve head 56 and plug member 52 apart thereby providing valve member 50 to be rotatably seated in transverse opening 54. In other embodiments, valve member 50 may be positioned in transverse opening 54 by some other suitable means whereby valve member 50 is rotatably seated. Being rotatably seated, valve member 50 is self-cleaning and liquid tight. Tapered inner portion 62 is complementary to the shape of valve head 56, namely, a frusto-conical or tapered shape in the embodiment illustrated. Tapered valve head 56 being complementary to tapered inner portion 62 enhances seating of valve member 50 and transverse opening 54. In another embodiment of the appliance 10, valve head 56 may be cylindrical or another shape so long as the size of valve head 56 is suitable for containing bore 58 therethrough.

Referring now to FIGS. 1 through 4 and 7, generally, the illustrated embodiment of the appliance 10 has a cold liquid passage 17 adjacent hot liquid passage 16 and extending vertically from hollow interior chamber 18 through extension portion 15 of body 14. As shown in FIG. 4, a suitable fitting 69 and flange 43 define check valve 68. Check valve 68 has a barbed stop 45, a flange or valve seat 43, and a floating ball 44 therebetween. Floating ball 44 being of suitable size whereby barbed stop 45 prevents floating ball 44 from passing downwardly relative to extension portion 15 and into suitable fitting 69. Flange 43 is of suitable dimensions whereby flange 43 acts as a valve seat and floating ball 44 communicates therewith to form liquid tight seal at 96. Floating ball 44 and flange 43 may be made of any suitable material having resilient properties enabling a liquid tight seal to be formed with flange 43. Barbed stop 45 is made of basic plumbing material.

Figure 5:
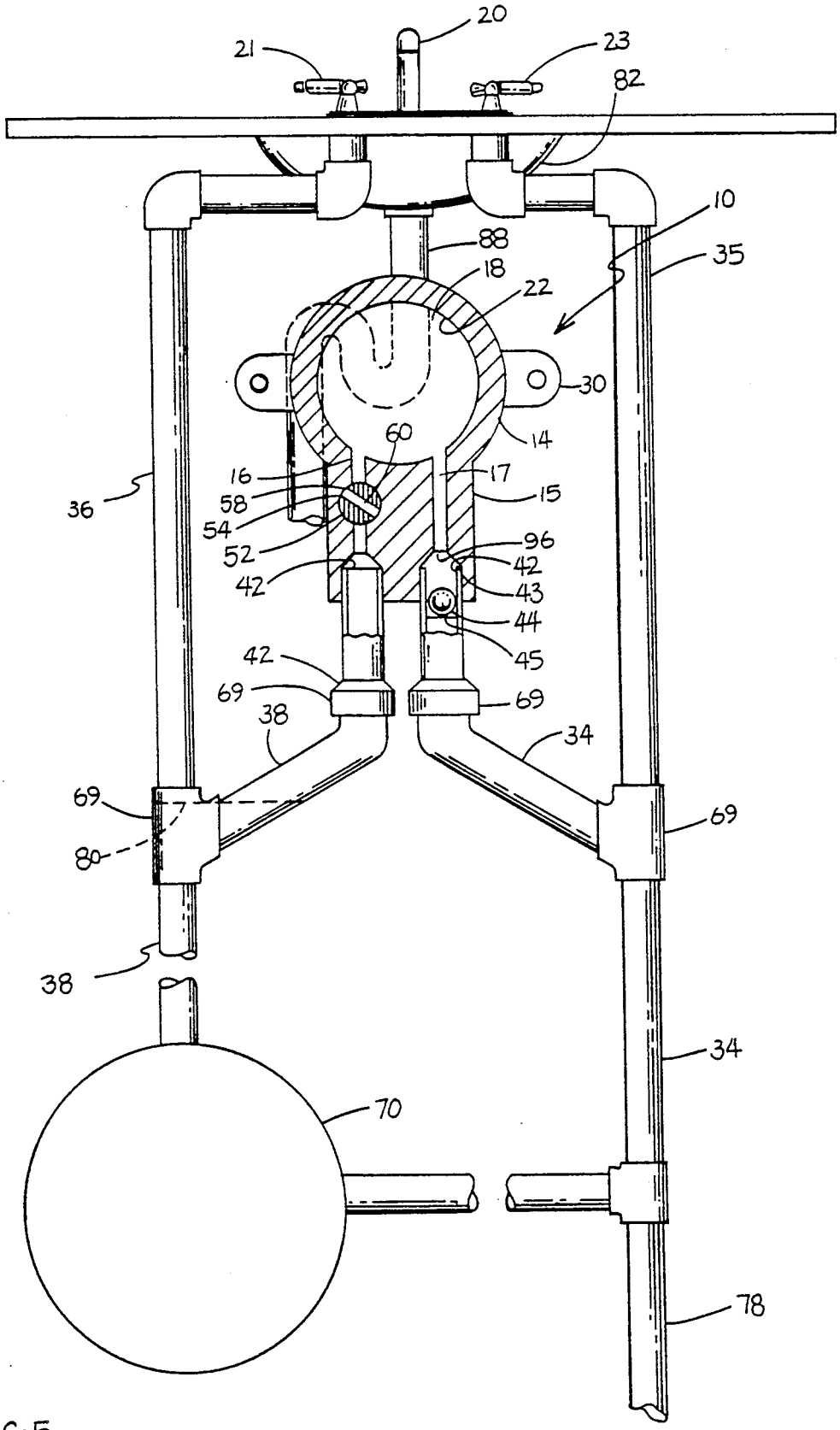
FIG. 5 is a view schematically showing the appliance mounted beneath a conventional faucet with flow valves.
Figure 6:
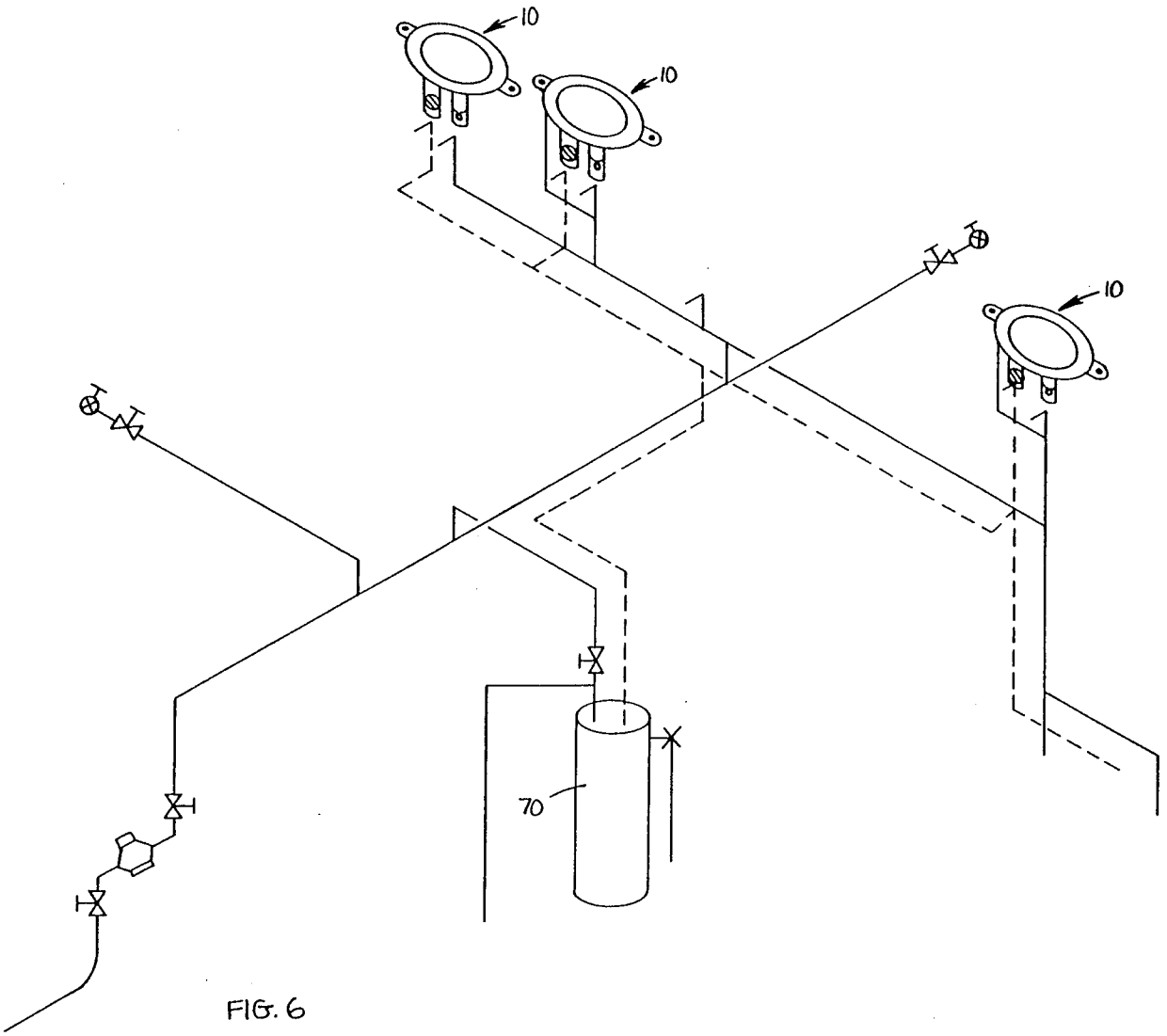
FIG. 6 is a view schematically showing a plurality of appliances of the invention.

Referring now to FIG. 5, appliance 10, in the embodiment illustrated, is secured by mounting ears 30 beneath a conventional sink 82 having a drain 88, faucet 20, hot liquid flow valve 21 and cold liquid flow valve 23. Appliance 10 is mounted at a higher level than or at a great distance from hot liquid heater 70. Hot liquid conduit 38 couples hot liquid heater 70 to suitable fitting 69 to hollow interior chamber 18, and cold liquid conduit 34 couples cold liquid source 78 to suitable fitting 69 to hollow interior chamber 18. Hot liquid conduit 36 and cold liquid conduit 35 are coupled to faucet 20 and the flow rate of hot liquid or water is controlled by hot liquid flow valve 21 and the flow of cold liquid or water is controlled by cold liquid flow valve 23. In another embodiment, appliances 10 are positioned near a plurality of conventional faucets and hot liquid and cold liquid flow valves. See FIG. 6. In all embodiments, body 14 is mounted at a level higher than or at a great distance from hot liquid source 70.

In operation, valve member 50, having slot 59 being suitable for receiving the working end of a standard screwdriver, can be adjusted whereby bore 58 is in partial alignment with hot liquid passage 16 thereby causing hot liquid to trickle through bore 58 of valve member 50 through hot liquid passage 16 and into hollow interior chamber 18 of appliance 10. This "trickling" results from the characteristic pressure differential between hot liquid source 70 and cold liquid source 78. Assuming hot liquid flow valve 21 and cold liquid flow valve 23 are in the closed position, the pressure differential above mentioned causes hot liquid to be forced from hot liquid source 70 into hot liquid conduit 38 and into hot liquid passage 16 and through partially aligned bore 58 and into hollow interior chamber 18. Heat transfer properties of liquid and the positioning of appliance 10 at a level higher than hot liquid source 70 create convectional and gravitational forces which cause the hot liquid to bleed or seep into the cold liquid passage 17 and mix with cold liquid therein. Bore 58 may be aligned more than partially with hot liquid passage 16 thereby affecting pressure differentials between hot liquid heater 70 and hollow interior chamber 18. In the embodiment illustrated, bore 58 is of equal diameter with hot liquid passage 16 and can be rotatably aligned whereby bore 58 is made to overlap hot liquid passage 16 as desired.

The increase in the area of overlap between bore 58 and hot liquid passage 16, controls the rate of flow of hot liquid therethrough and the temperature of the hot liquid available at faucet 20 as well. As bore 58 is adjusted toward a greater alignment with hot liquid passage 16, the flow rate of hot liquid therethrough and into hollow interior chamber 18 is increased. As the rate of flow of hot liquid from hot liquid heater 70 through hot liquid conduit 38 and into hollow interior chamber 18 increases, the time that the hot liquid spends traveling in hot liquid conduit 38 is decreased thereby conserving kinetic energy of the hot liquid molecules. Conversely, as bore 58 is aligned more partially with hot liquid passage 16, as shown in FIG. 1, the rate of flow of hot liquid from hot liquid heater 70 through hot liquid conduit 38 to hollow interior chamber 18 is slowed thereby resulting in a larger amount of kinetic energy of the hot liquid molecules being expelled, thus, having a cooling affect on the hot liquid proportional to the length of time the hot liquid spends traveling in hot liquid conduit 38 to hollow interior chamber 18. Rotatably seated valve member 50 therefore, controls the rate of flow of hot liquid through appliance 10 and the temperature of hot liquid available to faucet 20.

Valve member 50 permits selective control of the temperature of the hot liquid to be maintained at hot liquid outlet 16 and also permits complete shutoff of the hot liquid flow through appliance 10. Slot 59 receives flat working end of a screwdriver and bore 58 may be rotated as desired. It will be seen that selectively rotatable valve member 50 and its component parts are self-cleaning.

In the embodiment illustrated in FIGS. 1 and 5, check valve 68 positioned in cold liquid passage 17 has a floating ball 44 between a flange or valve seat 43 and a barbed stop 45. Flange 43 is complementary to floating ball 44 so that floating ball 44 and flange 43 form a liquid tight seal 96. Barbed stop 45 is of suitable dimensions to prevent floating ball 44 from passing therethrough. In operation of appliance 10, trickling hot liquid, as above described, traveling from hot liquid source 70 through hot liquid conduit 38 and into hollow interior chamber 18 and seeping or bleeding into cold liquid conduit 17 is able to proceed through barbed stop 45 with floating ball 44 resting thereon. Seeping of hot liquid into cold liquid conduit 34 continues where cooling hot liquid is returned to cold liquid. It will further be seen that check valve 68 provides the result described herein without parts subject to wear out.

Assuming valve member 50 is in partial alignment with hot liquid passage 16 and hot liquid flow valve 21 is open, the pressure differential between faucet 20 and hot liquid heater 70 is less than the pressure differential between flow valve 60 and hot liquid heater 70 thereby causing hot liquid to travel via hot liquid conduit 38 and bypass appliance 10 and continue traveling via hot liquid conduit 36 to faucet 20. Leaving hot liquid flow valve 21 in its open position and opening also cold liquid flow valve 23, cold liquid is made to travel under pressure from cold liquid source 78 via cold liquid conduit 34 and encounter check valve 68. Upon encountering check valve 68, cold liquid forces floating ball 44 against flange 43 and forming liquid tight seal 96 thereby preventing any cold liquid passage therethrough into cold liquid passage 17. Since the pressure differential between check valve 68 and cold liquid source 78 is greater than the pressure differential between faucet 20 and cold liquid source 78, cold liquid travels via cold liquid conduit 34 and cold liquid conduit 35 to conventional faucet 20.

By the appliance 10, hot liquid is available upon demand from faucet 20 and is maintained continuously at height 80. A plurality of appliances as the appliance 10 described herein, may be installed in hotel, motel, apartment building, or restaurant plumbing systems where it is desirous to have hot water available upon demand at the faucet 20 or where it is desirable to control the flow of hot liquid and the temperature thereof at a location more convenient than a basement or crawl space. Conventional faucet 20 includes bathtubs, sinks, showers, and appliance hook-ups, such as washing machines, as long as each are at a level above the hot liquid heater 70 of the system. The plumbing appliance 10 of the invention provides hot liquid available upon demand at all times, without wasting water, with a device with few parts, which need not be disassembled, cleaned, reassembled and reset, but rather, are self-cleaning and will not wear out.

While a specific embodiment of the invention has been shown and described herein for purposes of illustration, the protection afforded by any patent which may issue upon this application is not strictly limited to the disclosed embodiment; but, rather extends to all structures and arrangements which fall fairly within the scope of the claims which are appended thereto:

What is claimed is:

1. An appliance for use in a pressurized hot and cold liquid system for maintaining hot liquid at the outlet comprising a valve body having an enlarged chamber, said body having hot liquid and cold liquid conduits therein coupled to said chamber, a hot liquid outlet and a cold liquid outlet a source of hot liquid under pressure and means for transporting said hot liquid from said hot liquid source to said hot liquid conduit and to said hot liquid outlet, a source of cold liquid under pressure and means for transporting said cold liquid from said cold liquid source to said cold liquid conduit and to said cold liquid outlet, said hot liquid source being positioned spaced apart from said chamber and below said valve body, a flow valve in said hot liquid conduit for adjusting the flow of liquid through said hot liquid conduit, a check valve in said cold liquid conduit for preventing cold liquid from flowing through said cold liquid conduit and mixing with said hot liquid when said hot liquid is flowing from said hot liquid outlet and allowing hot liquid to flow through said hot liquid and cold liquid conduits and mix with cold liquid when hot liquid is not flowing through said hot liquid outlet, whereby hot liquid is always present at said hot liquid outlet.

2. The appliance of claim 1 wherein said hot liquid and cold liquid conduits are coupled to hot and cold liquid outlets respectively.

3. The appliance of claim 1 wherein said chamber has a cylindrical side wall and a pair of opposite end walls and a volume greater than the volume of a conduit similar in size to said hot and cold liquid conduits extending the distance therebetween.

4. The appliance of claim 1 wherein said hot liquid conduit and said cold liquid conduit extend downwardly and vertically relative to said top portion of said chamber.

5. The appliance of claim 1 wherein said body has an opening transverse of said hot liquid conduit, said opening being suitable for said flow valve to be rotatably seated therein.

6. The appliance of claim 5 wherein said opening and valve have threads securing said valve in said opening.

7. The appliance of claim 1 wherein said flow valve is a valve member having an adjusting valve stem with a forward end and a rear end, a valve head secured to said forward end and a slot in said rear end, said valve head having a bore extending therethrough, a compression spring positioned helically about said adjusting valve stem, said valve stem being selectively rotatable.

8. The appliance of claim 7 wherein said flow valve has a cylindrical plug member with internal wall and external wall, said internal wall being complementary to said compression spring, whereby said compression spring urges said plug member from said valve head.

9. The appliance of claim 8 wherein said opening and said external wall has threads, said threads being complementary.

10. An appliance for use in a pressurized hot and cold liquid system for maintaining hot liquid at the outlet comprising a valve body having an enlarged chamber, said body having hot liquid and cold liquid conduits therein coupled to said chamber, a hot liquid outlet and a cold liquid outlet, a source of hot liquid outlet and a cold liquid outlet, a source of hot liquid under pressure and means for transporting said hot liquid from said hot liquid source to said hot liquid conduit and to said hot liquid outlet, a source of cold liquid under pressure and means for transporting said cold liquid from said cold liquid source to said cold liquid conduit and to said cold liquid outlet, said hot liquid source being positioned spaced apart from said chamber and below said valve body, a flow valve in said hot liquid conduit for adjusting the flow of liquid through said hot liquid conduit, a check valve in said cold liquid conduit for preventing cold liquid from flowing through said cold liquid conduit and mixing with said hot liquid when said hot liquid is flowing from said hot liquid outlet and allowing hot liquid to flow through said hot liquid and cold liquid conduits and mix with cold liquid when hot liquid is not flowing through said hot liquid outlet, said hot liquid and cold liquid conduits being coupled to hot and cold liquid outlets respectively, said chamber having a cylindrical side wall and a pair of opposite end walls and a volume greater than the volume of a conduit similar in size to said hot and cold liquid conduits extending the distance therebetween, said hot liquid conduit and said cold liquid conduit extending downwardly and vertically relative to said chamber, said body having an opening transverse of said hot liquid conduit, said flow valve in said opening, said flow valve being selectively rotatable to allow flow through said valve.

11. The appliance of claim 10 wherein said check valve is positioned in said cold liquid conduit.

12. The appliance of claim 10 wherein said check valve having a valve seat and a barbed stop and a floating ball positioned therebetween.

13. The appliance of claim 10 wherein said body has pair of oppositely disposed mounting ears.

14. The appliance of claim 10 wherein said body is formed in one piece.

15. The appliance of claim 10 wherein said hot liquid and cold liquid outlets include taps.

16. The appliance of claim 10 wherein said hot liquid and cold liquid outlets include a plurality of taps.

17. An appliance for use in a pressurized hot and cold liquid system for maintaining hot liquid at the outlet comprising a valve body having an enlarged chamber said body having hot liquid and cold liquid conduits therein coupled to said chamber, a hot liquid outlet and a cold liquid outlet, a source of hot liquid under pressure and means for transporting said hot liquid from said hot liquid source to said hot liquid conduit and to said hot liquid outlet, a source of cold liquid under pressure and means for transporting said cold liquid from said cold liquid source to said cold liquid conduit and to said cold liquid outlet, said hot liquid source being positioned spaced apart from said chamber and below said valve body, a flow valve in said hot liquid conduit for adjusting the flow of liquid through said hot liquid conduit, a check valve in said cold liquid conduit for preventing cold liquid from flowing through said cold liquid conduit and mixing with said hot liquid when said hot liquid is flowing from said hot liquid outlet and allowing hot liquid to flow through said hot liquid and cold liquid conduits and mix with cold liquid when hot liquid is not flowing through said hot liquid outlet, said hot liquid and cold liquid conduits are coupled to hot and cold liquid outlets respectively, said chamber having a cylindrical side wall and a pair of opposite end walls and a volume greater than the volume of a conduit similar in size to said hot and cold liquid conduits extending the distance therebetween, said hot liquid conduit and said cold liquid conduit extending downwardly and vertically relative to said chamber, said body having an opening transverse of said hot liquid conduit, said flow valve being rotatably seated in said opening, said flow valve being selectively rotatable to allow flow through said valve, said check valve being positioned in said cold liquid conduit, said check valve having a valve seat and a stop and a floating ball positioned therebetween.

* * * * *